US006106749A

United States Patent [19]

Adly

[11] Patent Number: 6,106,749

[45] Date of Patent: Aug. 22, 2000

[54] METHOD AND MACHINE FOR MAKING CONCRETE PIPE

[76] Inventor: Tarek A. Adly, 8760 Columbine Cir., Baldwinsville, N.Y. 13027

[21] Appl. No.: 09/003,934

[22] Filed: Jan. 7, 1998

Related U.S. Application Data

[60] Provisional application No. 60/034,652, Jan. 8, 1997.

[51] Int. Cl.[7] ..... B28B 21/28

[52] U.S. Cl. ..... 264/40.1; 264/333; 425/262; 425/145; 425/427; 425/150

[58] Field of Search ..... 425/262, 427, 425/460, 145, 149, 130, 150; 264/40.1, 40.5, 333

[56] References Cited

U.S. PATENT DOCUMENTS

| | | | |
|---|---|---|---|
| 1,137,776 | 5/1915 | Miller | 425/262 |
| 3,262,175 | 7/1966 | Gourlie et al. | 425/262 |
| 3,551,968 | 1/1971 | Fosse et al. | 425/262 |
| 3,619,872 | 11/1971 | Fosse | 425/262 |
| 3,746,494 | 7/1973 | Gauger | 425/262 |
| 4,340,553 | 7/1982 | Fosse | 425/262 |
| 4,406,605 | 9/1983 | Hand | 425/145 |
| 4,407,648 | 10/1983 | Fosse | 425/262 |
| 4,639,342 | 1/1987 | Adly | 425/262 |
| 4,690,631 | 9/1987 | Haddy | 425/262 |
| 4,957,424 | 9/1990 | Mitchell et al. | 425/145 |
| 5,147,196 | 9/1992 | Adly | 425/145 |
| 5,167,967 | 12/1992 | Adly | 425/145 |

*Primary Examiner*—Robert Davis
*Assistant Examiner*—Thukhanh T. Nguyen

[57] ABSTRACT

A method and apparatus for making concrete pipe with a packerhead concrete pipe making machine having a lift operable to selectively raise and lower the packerhead during the forming of a concrete pipe in a mold while a conveyor delivers a constant supply of concrete to the mold. The operating speed of the conveyor only increases or decreases when the motor load signal which is proportional to the load on the motor that turns the packerhead falls below or goes above lower and upper motor load reference limits. The lift speed of the packerhead varies with the vertical positions of the packerhead relative to the mold.

27 Claims, 4 Drawing Sheets

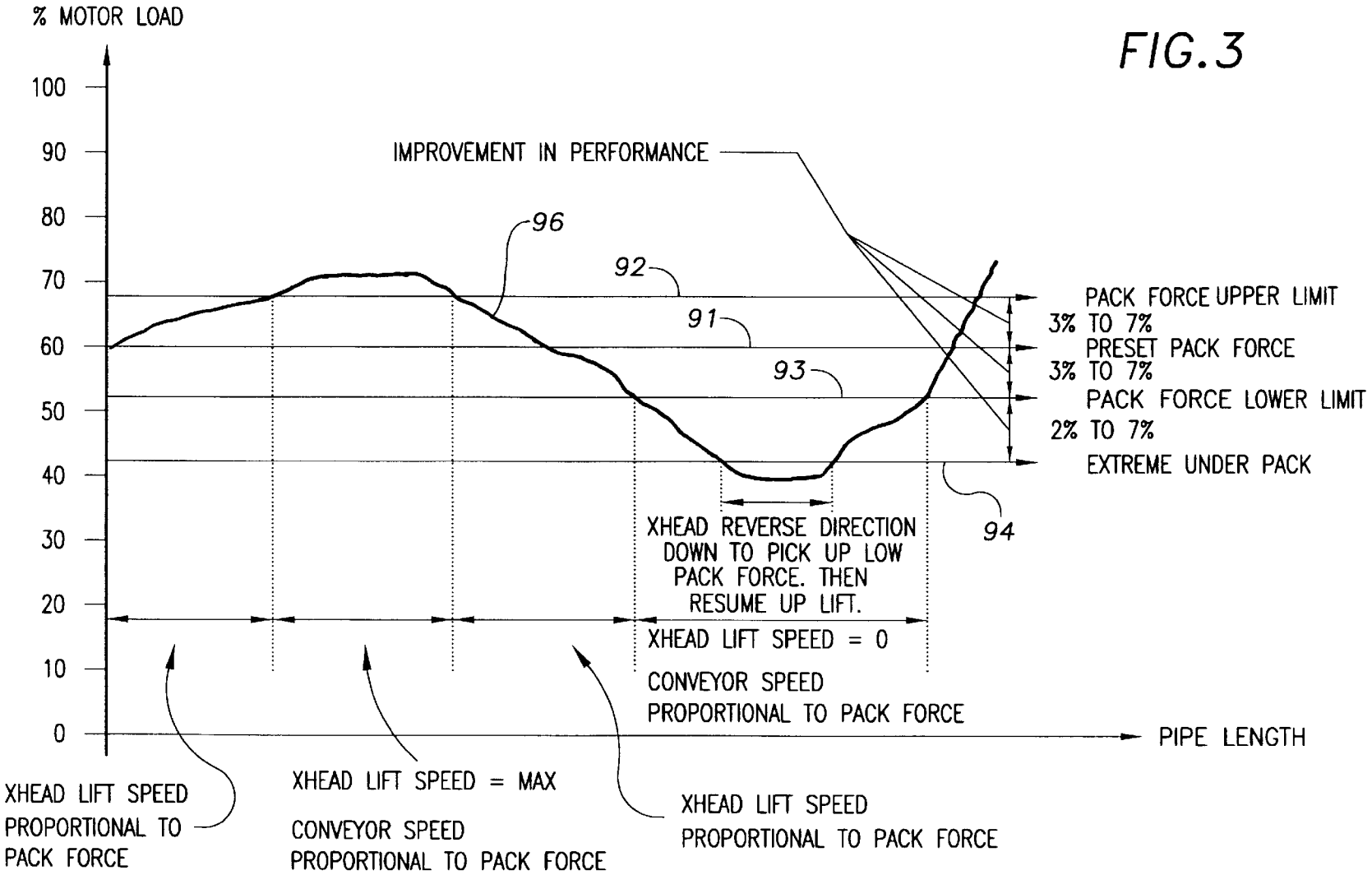
FIG. 3
% MOTOR LOAD
100
90
80
70
60
50
40
30
20
10
0
PIPE LENGTH
PACK FORCE UPPER LIMIT
3% TO 7%
PRESET PACK FORCE
3% TO 7%
PACK FORCE LOWER LIMIT
2% TO 7%
EXTREME UNDER PACK
IMPROVEMENT IN PERFORMANCE
96
92
91
93
94
XHEAD REVERSE DIRECTION DOWN TO PICK UP LOW PACK FORCE. THEN RESUME UP LIFT.
XHEAD LIFT SPEED = 0
CONVEYOR SPEED PROPORTIONAL TO PACK FORCE
XHEAD LIFT SPEED PROPORTIONAL TO PACK FORCE
XHEAD LIFT SPEED = MAX
CONVEYOR SPEED PROPORTIONAL TO PACK FORCE
XHEAD LIFT SPEED PROPORTIONAL TO PACK FORCE

METHOD AND MACHINE FOR MAKING CONCRETE PIPE

CROSS REFERENCE TO RELATED APPLICATION

This application claims the priority of U.S. Provisional Patent Application Ser. No. 60/034,652 filed Jan. 8, 1997.

TECHNICAL FIELD

The invention is in the field of concrete pipe making machines known as packerhead machines and methods of making concrete pipes. A packerhead machine has a conveyor for moving concrete into the mold above the packerhead. A drive on a crosshead rotates the packerhead. Hydraulic cylinders attached to the crosshead move the crosshead and packerhead to form the pipe in the mold. The operating speed of the conveyor and the lift speed of the packerhead are used to form a concrete pipe having uniform density throughout the length of the pipe.

BACKGROUND OF THE INVENTION

Packerhead concrete pipe making machines have rotatable packerheads that are moved in an upward direction in molds to form concrete pipes. Conveyors operate to move the concrete from hoppers into the molds above the packerheads. The amount of concrete in the molds above the packerheads is related to the torque required to rotate the packerheads. The operating speeds of the conveyors are used to control the supply of concrete in the molds. An apparatus for forming a concrete pipe having a control to adjust the rate of concrete supplied by the conveyor to the mold is disclosed by G. E. Hand in U.S. Pat. No. 4,406,605. In this apparatus the horsepower of the drive motor for the packerhead is sensed and used to adjust the operating speed of the conveyor to control the rate of concrete moved into the mold. There is time delay in adjusting the operating speed of the conveyor which can cause soft spots in the pipe formed in the mold. This control does not modulate the lift rate of the packerhead to self compensate for overpack and underpack conditions.

F. Gauger in U.S. Pat. No. 3,746,494 discloses a method and apparatus for making concrete pipe having uniform compaction. The torque supplied by the packerhead motor during the formation of the pipe varies with the rate of supply of concrete. This torque signal is used to decrease the rate of rise of the packerhead when there is a decrease in the torque and increase the rate of rise of the packerhead when there is an increase in the torque signal. Unset concrete is supplied to the mold at essentially a constant rate.

T. A. Adly in U.S. Pat. No. 4,639,342 describes a combined concrete feed and packerhead lift control for a packerhead concrete pipe making machine to produce a pipe having substantially uniform density throughout the length of the pipe. The rate of concrete directed into the mold is controlled by varying the operating speed of the conveyor motor in response to the packerhead motor load signal. This is the primary control for maintaining uniform density of the concrete in the pipe. Upper and lower limits of the packerhead motor load signal are selected to identify permissible limits of overpacking and underpacking of the concrete. The lift speed of the packerhead is increased when the motor load signal exceeds the upper limit and decreased when the motor load signal falls below the lower limit. The lift speed remains substantially constant when the packerhead motor load signal is between the upper and lower limits.

SUMMARY OF THE INVENTION

The present invention is a method and apparatus for controlling the lift speed of the packerhead as the primary means to ensure substantially uniform density of concrete throughout the length of the pipe made by a packerhead concrete pipe making machine. The lift speed of the packerhead changes in proportion to the pack force and the conveyor speed is selected at a constant rate between a pack force upper limit and pack force lower limit. When the pack force upper limit is exceeded, the conveyor speed decreases and is proportional to the pack force to reduce the amount of concrete directed into the mold. When the pack force falls below the pack force lower limit the conveyor speed increases to add more concrete to the mold. Under extreme underpack conditions the upward movement of the packerhead will stop and the packerhead will move back down in the mold to pick up the low pack force. When the low pack force has been established the upward movement of the packerhead resumes. This control of the lift speed of the packerhead in accordance with the pack force with supplementary control of the conveyor speed above and below pack force upper and lower limits overcomes the time delay problems of the prior controls for the conveyor speed to provide a supply of concrete in the mold and improves the speed and performance of the packerhead concrete pipe making machine.

The concrete feeding device has a cone shaped funnel located below a ring having wipers for pushing concrete from the cone into the mold. A motor drives the ring as shown in U.S. Pat. No. 3,551,968. The feeding device can jam due to overfill of concrete. A sensor signals the controller that the feeding device has stopped. The controller provides a timed reversing signal to reverse the operation of the motor to turn the feeding device in a reverse direction for a selected period of time to clear the feeding device. The controller then signals the motor to return to normal operation to return the feeding device to its normal forward direction of operation. dr

DESCRIPTION OF THE DRAWINGS

FIG. 3 is a diagram showing variations in the percentage of motor load of the packerhead drive motor over the length of the pipe in conjunction with the crosshead lift speed and conveyor speed.

DESCRIPTION OF THE PREFERRED EMBODIMENTS

Figure 1:
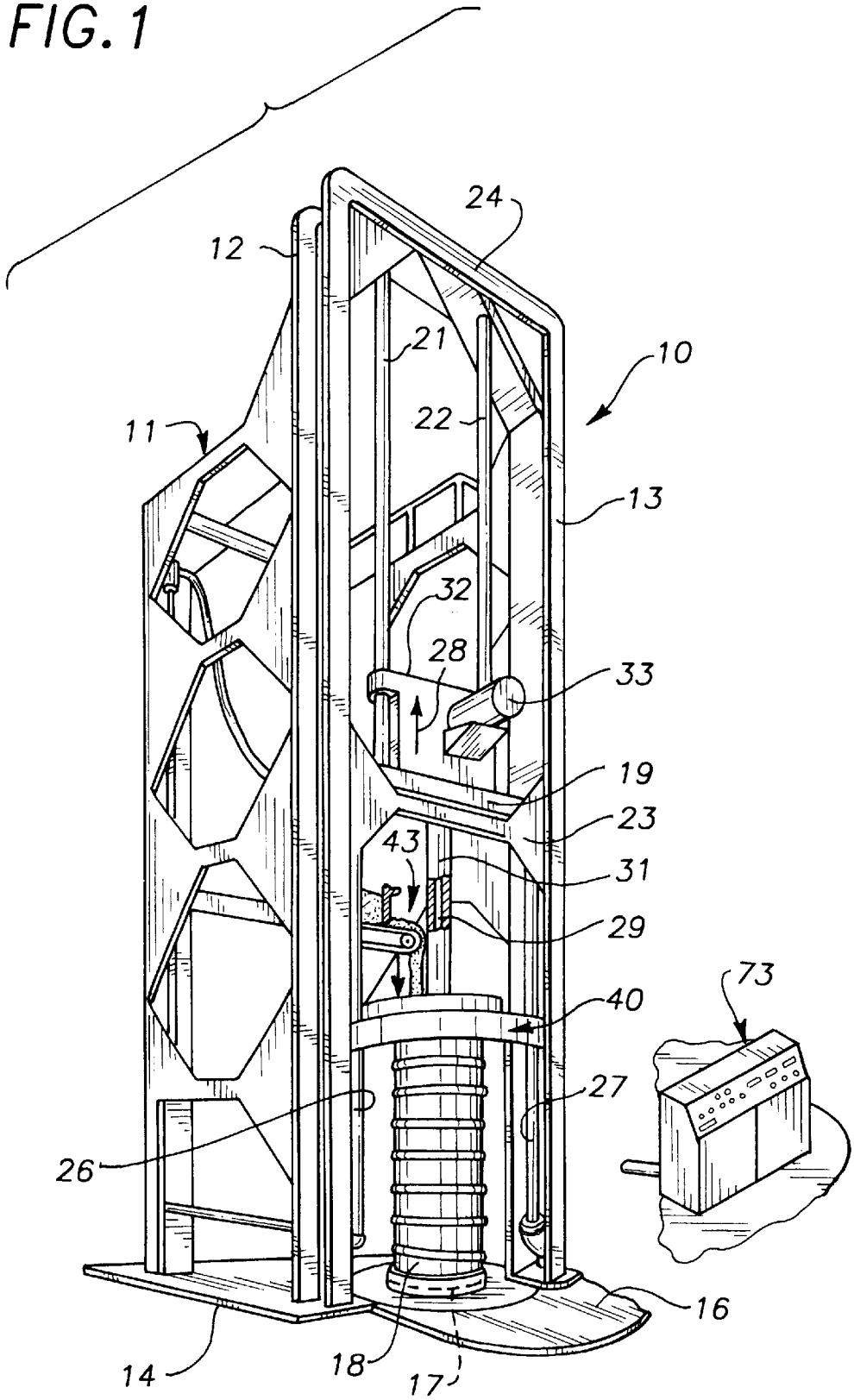
FIG. 1 is a perspective view of a packerhead concrete pipe making machine equipped with the machine controller and program of the invention.

Referring to FIG. 1, a packerhead concrete pipe making machine 10 has an upright framework 11 comprising a number of upright beams and crossbeams including main upright front I-beams 12 and 13. The mid-portions of beams 12 and 13 are secured to a crossbeam 23. A top crossbeam 24 is secured to the top of the beams 12 and 13. The beams and crossbeams of the framework are welded together to provide a strong unitary framework.

Machine 10 is supported on a base or floor 14 which carries a rotatable horizontal turntable 16, only a portion of which is shown in FIG. 1. Turntable 16 supports a plurality of pallets 17 and cylindrical jackets or molds 18 such that pallets 17 and molds 18 can be rotated into the position shown in FIG. 1 to facilitate rapid operation of pipe making machine 10.

A crosshead 19 extends horizontally between beams 12 and 13 above crossbeam 23. A pair of upright cylindrical guides 21 and 22 support crosshead 19 for vertical movement between a first or lowered position as shown in FIG. 1 and a second or raised position adjacent the top crossbeam 24. The lower ends of guides 21 and 22 are secured to crossbeam 23, and the upper ends of guides 21 and 22 are secured to crossbeam 24.

A pair of hydraulic packerhead lift cylinders 26 and 27 supported adjacent the lower ends of beams 12 and 13 are attached to opposite ends of crosshead 19. Lift cylinders 26 and 27 are double acting hydraulic fluid operated piston and cylinder assemblies operable to move crosshead 19 and a packerhead 34 supported thereby along a path defined by the vertical guides 21 and 22 and indicated by arrow 28, seen in FIG. 2. In large machines, each of lift cylinders 26 and 27 can be replaced by pairs of lift cylinders to accommodate heavier loads. Cylinders 26 and 27 are supplied with hydraulic fluid, such as oil, under pressure by a pump 68, shown in FIG. 2.

Figure 2:
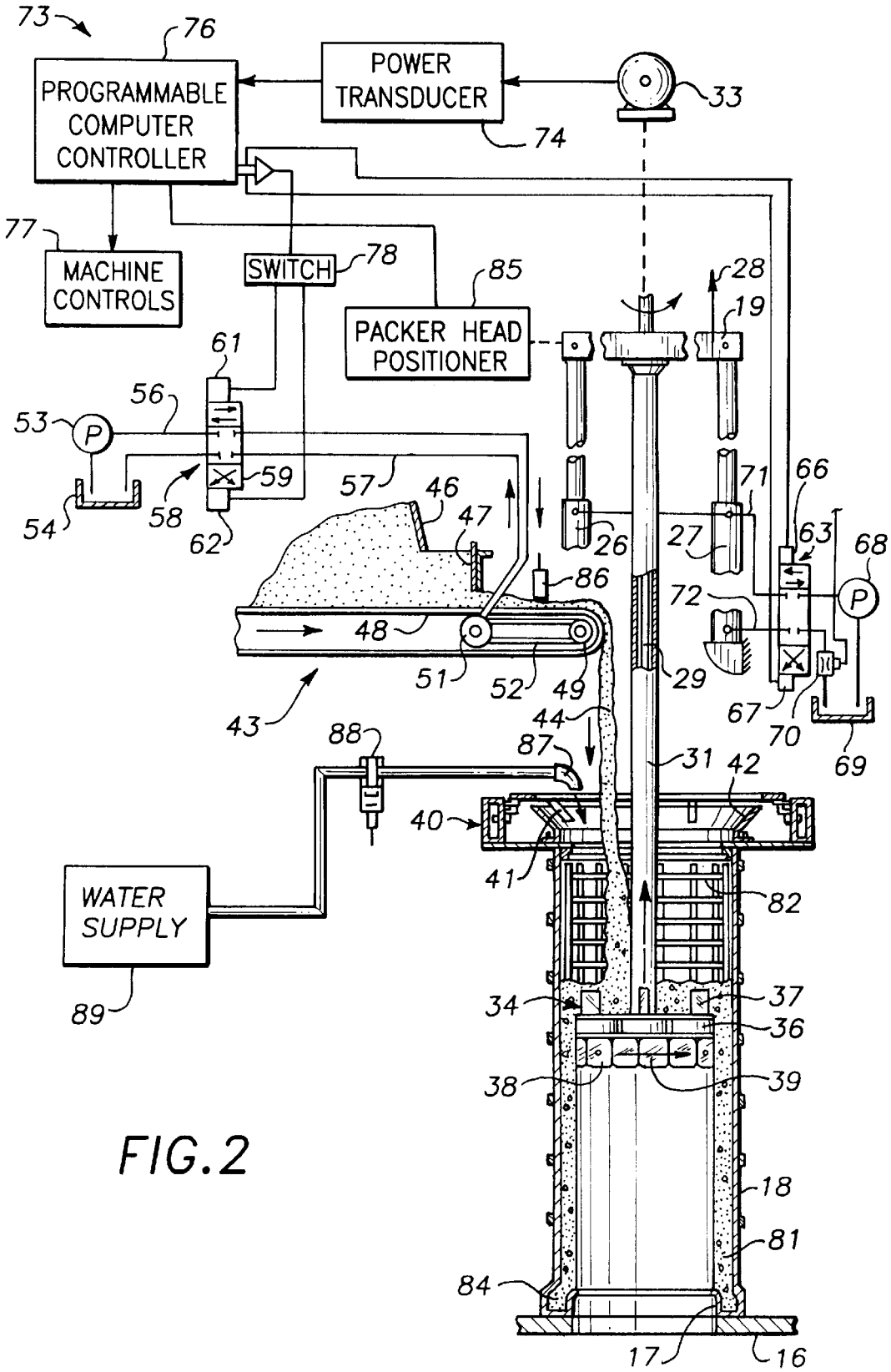
FIG. 2 is a diagrammatic view of the packerhead concrete pipe making machine of FIG. 1.

As shown in FIG. 2, crosshead 19 supports a downwardly directed drive shaft 29 which is surrounded by a downwardly directed sleeve 31. A packerhead 34 is connected to the lower end of drive shaft 29. The upper end of drive shaft 29 is connected to a power transmission (not shown) which is mounted on top of crosshead 19. A motor 33, which can be either electrically or hydraulically powered, rotates drive shaft 29 through the power transmission.

Packerhead 34 has a plurality of rollers 36, preferably five. Each roller 36 carries at least one upwardly directed fin or blade 37 for working and moving concrete in an outward direction against the inside wall of mold 18. An annular trowel 38 is located below the rollers 36. Examples of packerheads having rollers and annular trowels are disclosed by L. C. Gourlie et al in U.S. Pat. No. 3,262,175 and H. L. Haddy in U.S. Pat. No. 4,690,631. Packerhead 34 is rotated in the direction of arrow 39 by operation of motor 33. Packerhead 34 is simultaneously rotated and lifted through mold 18 to form a concrete pipe therein. The packerhead lift motion is controlled or modulated and the amount of concrete discharged into the mold is controlled in accordance with the present invention to ensure substantially constant concrete packing force or pressure on the concrete deposited into mold 18 as will be described hereinafter.

The location of packerhead 34 relative to mold 18, pallet 17 and top table 40 is sensed by a packerhead positioner 85 operatively associated with crosshead 19 and wired to a controller 76. Positioner 85 can be a number of limit switches or a rotary switch operable in response to vertical positions of crosshead 19 or packerhead 34. Positioner 85 generates packerhead location signals used by controller 76 to change, stop or reverse the lift speed of packerhead during the forming of the bell, barrel, and tongue sections of the pipe as hereinafter described.

Machine 10 has a top or feeder table 40 located adjacent the top of mold 18. Table 40 supports a concrete feeding device 41 having a downwardly converging funnel or cone member 42. Wipers or blades attached to a rotatable annular member are moved with a hydraulic motor to remove concrete from cone 42 and direct the concrete into mold 18. The concrete feeding device 41 is the subject matter of U.S. Pat. No. 3,551,968 which is incorporated herein by reference. Another concrete feeding device is disclosed by S. J. Miller in U.S. Pat. No. 1,137,776. The operation of the motor for feeding device 41 is sensed by a sensor which signals controller 76 to determine when feeding device 41 is operating. The feeding device 41 can jam due to overfilling of concrete on the cone 42. A sensor senses that the wiper is not operating. When feeding device 41 is stopped, controller 76 provides a timed reversing signal to reverse the operation of the motor to turn feeding device 41 in a reverse direction for a selected period of time to clear concrete from cone 42 and push the concrete into mold 18. Controller 76 then signals the motor to return to normal operation to return feeding device 41 to its normal forward direction of operation.

Hydraulic cylinders connected to feeding device 41 operate to hold down feeding device 41 on mold 18 and to selectively raise and lower the feeding device 41 relative to the top of mold 18. Table 40 is equipped with an absolute encoder to feedback the actual position of table 40 relative to mold 18 to controller 76. Table 40 is moved at a fast rate of speed toward the top of mold 18 and is slowed down before reaching its down position on the top of mold 18. This allows a faster cycle when producing multi-length pipes in sequence. The speed of movement of table 40 is synchronized with the crosshead 19 slow speed to clear the table ring.

The crosshead 19 and packerhead 34 speed will slow down when packerhead 34 reaches the tongue area of the pipe. When the tongue of the pipe is completed table 40 will start to rise at a slow speed to minimize disruption of the tongue. After the table clears the tongue area both the packerhead 34 and table 40 start their fast lift.

A conveyor 43 is operable to discharge concrete 44 through feeding device 41 into mold 18 above packerhead 34. An endless belt 48 is driven by a drive roller 49 to move concrete 44 from a hopper or storage bin 46 to mold 18. The outlet of hopper 46 has adjustable gate 47 located above endless belt 48 to adjust the thickness of the ribbon of concrete 44 carried by conveyor 43 for various sizes of pipe.

An electronic moisture sensor 86 wired to a programmable computer controller 76 senses the moisture content of the concrete moved from hopper 46 by conveyor 43 to mold 18. Controller 76 responsive to signals from sensor 86 operates a valve assembly 80 that controls the flow of water to the concrete to maintain the moisture content of the concrete at a preset amount.

A motor 51, shown in FIG. 2 as a hydraulic motor, is connected to driver roller 49 by a belt or chain drive 52. The speed of motor 51 in prior controls of packerhead concrete pipe making machines is controlled to regulate the speed of belt 48 and, hence, the amount of concrete 44 that is discharged into mold 18 above packerhead 34. The amount of concrete discharged into the mold may be more than is required or less than is needed to make a concrete pipe. The control system of the invention overcomes these disadvantages of the prior controls of packerhead concrete pipe making machines. While motor 51 can be an electric motor, such as a D.C. electric motor, the illustrated hydraulic motor is operatively coupled to a pump 53 through hydraulic lines or hoses 56 and 57. The pump 53 delivers pressurized hydraulic fluid through lines 56 and 57 connected to the proportional valve assembly 58, which includes a movable spool or valving member as is well known in the art.

A pair of solenoids 61 and 62 selectively position the valving member of valve assembly 58 to control the amount of flow and the direction of flow of pressurized hydraulic fluid to motor 51. The speed of motor 51 is maintained constant within an upper and lower adjustable pack force. FIG. 3 is a diagram showing the preset motor load signal 91 and upper and lower limit reference signals 92 and 93 on opposite sides of the preset motor load signal. The upper and lower limit reference signals 92 and 93 can vary between 3 to 7 percent from the preset motor load signal. An extreme underpack motor load signal 94 is between 2 to 5 percent below the lower limit reference signal. An example of a graphic representation of the variations in the actual motor load is represented by graph line 96. When the crosshead speed slows down or speeds up to maintain the pack force within the proper pack setting, conveyor belt 48 moves at a constant speed depositing a constant amount of concrete into mold 18. When the pack force crosses either upper or lower limits, conveyor motor 51 speed is automatically adjusted to alter conveyor belt speed to provide the proper amount of concrete in mold 18 for these extreme pack situations. The primary control to maintain a desired pack force on packerhead 34 is the regulation of the lift speed of packerhead 34 with a constant discharge of concrete into mold 18 by conveyor 43. The controller 76 also allows the lift speed of packerhead 34 to stop and reverse the direction of movement of packerhead 34 to where the underpack portion of the pipe is located. When the pack force attains its preset or desired level, the lift speed of packerhead 34 is resumed.

A second control valve assembly 63 is connected to hydraulic lines 71 and 72 leading to the opposite ends of packerhead lift cylinders 26 and 27. A pump 68 is operable to draw hydraulic fluid, such as oil, from the reservoir 69 and to supply pressurized fluid to valve assembly 63. A proportional valve 70 is interposed in the discharge line leading from valve assembly 63 to reservoir 69 for modulation of the packerhead lift rate.

Valve assembly 63 receives a movable spool or valving member. The position of the valving member is controlled by a pair of solenoids 66 and 67 wired to controller 76 to regulate the supply of hydraulic fluid to lift cylinders 26 and 27 and the return of hydraulic fluid therefrom. Proportional valve 70 has an infinitely variably positioned valving member for controlling hydraulic fluid flow as directed by control signals from a control system 73.

Controller 76 monitors the crosshead speed that has been selected for a certain pipe size and type of concrete mix. The monitoring function also ascertains the changes in how the crosshead 19 and conveyor 43 are modulating to maintain the pack force within the selected limits. Controller 76 will automatically adjust either the crosshead preset speed or the conveyor preset speed or their automatic speed control sensitivity to compensate for the changes that occur during the day like changes in the temperature, mix design or water content of the mix, that affect the automatic speed controls of the crosshead 19 and conveyor 43. Controller 76 corrects the preset values of operation of crosshead 19 and conveyor 43 to allow the machine to self adjust to work under optimum conditions.

Figure 4:
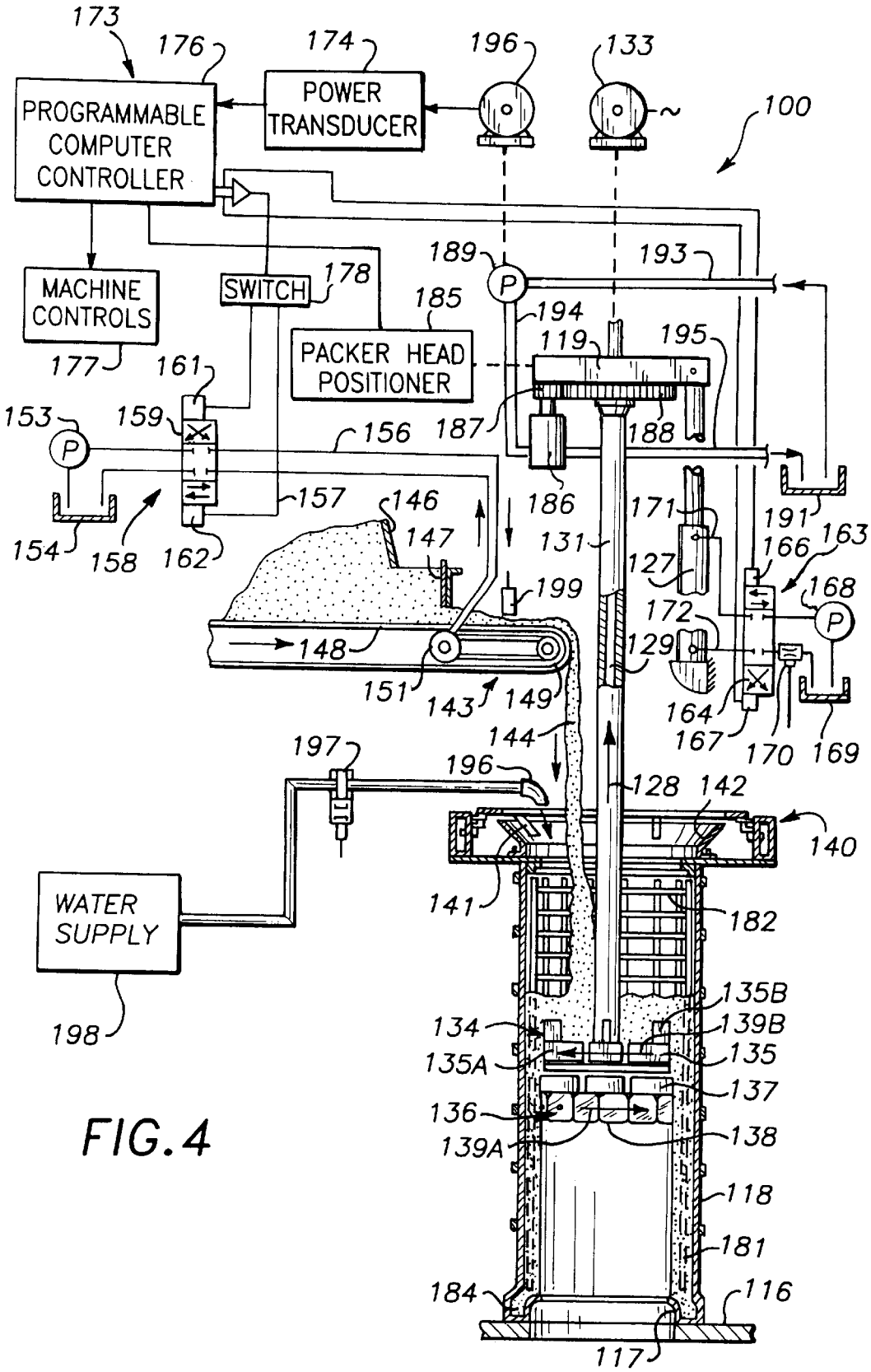
FIG. 4 is a diagrammatic view of a packerhead concrete pipe making machine having a counterrotating packerhead with the machine controller and program of the invention.

FIG. 4 shows diagrammatically a counterrotating packerhead concrete pipe making machine 100 of the type disclosed by N. T. Fosse in U.S. Pat. No. 4,340,553, and T. A. Adly in U.S. Pat. No. 4,639,342 which is incorporated by reference. Machine 100 comprises a framework like that of the machine 10 and including crosshead 119 and lift cylinders 127 (only one being shown) for moving the crosshead assembly vertically as shown by arrow 128.

A counterrotating packerhead 134 includes an upper packerhead unit 135 and a lower packerhead unit 136. The upper packerhead unit 135 has a plurality of circumferentially spaced rollers 135A carrying upwardly directed blades or fins 135B. The lower packerhead unit 136 has a plurality of rollers 137 and an annular trowel 138. N. T. Fosse in U.S. Pat. No. 4,407,648 describes a counterrotating packerhead for a concrete pipe making machine.

The location of packerhead 134 relative to mold 118, pallet 117 and top table 140 is sensed by a packerhead positioner 185 operatively associated with crosshead 119 and wired to controller 176. Positioner 185 can be a series of limit switches or a rotary switch assembly that generates packerhead location signals used by controller 176 to change the lift speed of packerhead 134 during the forming of the bell, barrel, and tongue sections of the pipe.

A shaft 129 depends from crosshead 119 through a sleeve 131. Shaft 129 supports the lower packerhead unit 136 and is driven by a motor 133 at its upper end to rotate lower packerhead unit 136 in the direction of arrow 139A. Sleeve 131 supports upper packerhead unit 135 which is rotated in the opposite direction as indicated by arrow 139B by a hydraulic motor 186 through a gear train power transmission 187, 188 and sleeve 131. While motors 133 and 186 could be either electric or hydraulic, as illustrated in FIG. 3, motor 133 is electric and motor 186 is hydraulic.

A top table 140 includes a table wiper assembly 141 which is located above mold 118. The wiper assembly 141 has a downwardly directed cone or funnel 142 which directs concrete 144 into the mold 118. A plurality of wipers or blades secured to a horizontal annular member are moved with a hydraulic motor in a circular path around funnel 142 to push concrete off funnel 142 and into mold 118. The table wiper assembly 141 is part of a concrete feeding device that is the subject of U.S. Pat. No. 3,551,968, incorporated by reference. The operation of the motor for feeding device 141 is sensed by controller 176 to determine when feeding device 141 is operating. When feeding device is stopped, controller 176 provides a timed reversing signal to reverse the operation of the motor to operate feeding device 141 in a reverse direction for a selected period of time to clear concrete from funnel 142 and direct the concrete into mold 118. Controller 176 then signals the motor to return to normal operation thereby operating feeding device 141 in its forward direction.

A conveyor 143 delivers concrete 144 to mold 118 from a hopper 146 on a continuous belt 148 which moves under a hopper gate 147. Belt 148 is trained over a drive roller 149 connected to a motor 151 by a belt or chain. As shown in FIG. 3, motor 151 is hydraulic and is supplied with hydraulic fluid under pressure by a pump 153 which has an input line 156 connected to the motor 151. A return line 157 carries hydraulic fluid from motor 151 back to reservoir 154. The motor for operating conveyor 143 can be an electric motor.

A solenoid operated proportional valve assembly 158 is interposed in hydraulic lines 156 and 157 and includes a body 159 and a moveable spool or valving member. Solenoids 161 and 162 control the position of the valving member and thereby control the flow of hydraulic fluid to motor 151 and regulate the speed of operation of conveyor 143. The operating speed of conveyor 143 is maintained constant within an upper and lower adjustable pack force. When the crosshead speed slows down or speeds up to maintain the pack force within the proper pack setting, conveyor belt 148 moves at a constant speed depositing a constant amount of concrete into mold 118. The lift speed of crosshead 119 is changed to maintain the selected pack force on packerhead 134. When the pack force crosses either upper or lower limits, conveyor motor 151 speed is automatically adjusted to alter conveyor belt speed to provide the proper amount of concrete in mold 118 for these extreme pack situations. The primary control to maintain a desired pack force on packerhead 134 is the regulation of the lift speed of the crosshead 119 with a constant discharge of concrete into mold 118 by conveyor 143. The controller 176 also allows the lift speed of packerhead 134 to stop and reverse directions of movement of packerhead 134 to where the underpack portion of the pipe is located. When the pack force attains its preset level, the preset lift speed of packerhead 134 is resumed.

An electronic moisture sensor 199 wired to a computer controller 176 is operable to sense the moisture content of the concrete carried by conveyor 143 to mold 118. Controller 176 responsive to signals from sensor 199 operates a valve assembly 197 that controls the flow of water to concrete to maintain the moisture content of the concrete at a preset amount.

A second pump 189 is driven by an electric motor 196 to draw hydraulic fluid from a reservoir 191 through a hydraulic line 193 and discharge the fluid under pressure to a hydraulic line 194 connected to hydraulic motor 186. Hydraulic fluid under pressure from the pump 189 operates motor 186 to rotate the upper packerhead unit 135. Hydraulic fluid from the motor 186 is discharged back to reservoir 191 through a hydraulic line 195.

A power transducer 174, which is the same as the power transducer 74 shown in FIG. 2, is operable to sense the power used by motor 196 and to generate a motor load signal that is passed to a computer controller 176 which is the same as the computer controller 76 identified above. The motor load signal is proportional to the pack force of packerhead 134 on the concrete in mold 118 during the forming of the concrete pipe. Since motor 196 drives pump 189, the power used by motor 196 is a function of the hydraulic pressure generated by pump 189, and which in turn is a function of the torque applied to the upper packerhead unit 135 during formation of pipe 181.

Computer controller 176 generates output signals which control the operation of the lift cylinders 127 for packerhead 134 as hereinafter described.

Packerhead assembly 134 is moved in a upward direction in mold 118 by hydraulic cylinders 127 while the upper packerhead unit 135 and the lower packerhead unit 136 are counterrotating. A control valve assembly 163 connects a pump 168 to opposite ends of cylinders 127. Valve assembly 163 has a body 164 which includes a spool or valving member.

A pair of solenoids 166 and 167 control the operation of valve 163. A proportional valve 170 is interposed in the discharge line leading from valve assembly 163 to a reservoir 169 to thereby control the speed of the upward movement of lift of packerhead assembly 134, as well as its downward movement.

The output signals from power transducer 74 are fed to computer controller 76 and the output signals from power transducer 174 are fed to controller 176. The computer controllers 76 and 176 are programmed to control a two-pass packerhead machine and a one-pass counterrotating packerhead machine, respectively. While these programs are different to accommodate differences in the concrete pipe making machines, the present invention is applicable to both types of machines.

While the present invention is described with reference to single and counterrotating packerhead concrete pipe making machines, it will be apparent to those skilled in the art that the present invention can be incorporated into almost any packerhead machine control system. The following machine control is directed to packerhead machine 10 shown in FIG. 2. The same machine control system is applicable to the packerhead machine shown in FIG. 4.

Control system 73 includes a programmable computer controller 76 operable to coordinate the entire operation of machine 10 in a manner to form concrete pipes. Computer controller 76 generates output command signals which operate machine controls 77, such as automatic cycling of the operations, including bell feed, adding bell water, making a controlled first pass, operating the table top wiper, stopping the concrete flow at the top of the pipe and second pass operations as is well known in the art.

In addition, control system 73 has been modified in accordance with the present invention to control the rate of lift of packerhead 34 to overcome excessive overpack and underpack conditions and thereby to ensure substantially uniform concrete compaction and density throughout the length of a pipe as will be described.

The prior controls for packerhead concrete pipe making machines are predicated on controlling the speed of conveyor 43 according to the actual pack force on the pipe being produced in mold 18. A problem with using conveyor 43 to deliver the required amount of concrete to mold 18 above packerhead 34 is the response time of conveyor 43 to change the amount of concrete delivered by the conveyor to mold 18. At the bell or bottom of mold 18 the distance between the discharge end of conveyor 43 and packerhead 34 creates a several second delay for either the extra concrete needed to arrive to packerhead 34 or the excess concrete falling into the mold to be utilized in forming the pipe. This delay creates some unevenness in the packing of concrete in the bell section of the pipe.

In the prior controls for packerhead concrete pipe making machines the packerhead lift speed starts to be controlled when the pack force is over an upper or below a lower dead band pack force as disclosed in U.S. Pat. No. 4,639,342. The dead band is the upper and lower limits acceptable for a good packing of the pipe. The conveyor speed is modulated from a maximum preset speed down to the best feed speed to maintain the proper pack force and obtain when the conveyor speed is maximum. Under these conditions conveyor 43 discharges excess concrete into the mold whereby packerhead 34 has a tendency to overpack the pipe. This increases the pack force of packerhead 34 on the concrete in mold 18 thereby triggering the packerhead lift speed control to cause packerhead 34 to increase its upward speed. In many cases soft spots in the pipe are created when packerhead 34 moves upwardly at a fast rate of speed.

During the production day the concrete consistency changes due to many factors. Compensation for these changes in concrete consistency in prior controls for packerhead concrete pipe making machines is accomplished by altering the conveyor speed and in many cases increasing the conveyor speed to its maximum to discharge sufficient concrete to the mold to make a satisfactory pipe. The lift speed of the packerhead will slow down when there is insufficient concrete in the mold. The slow down of the lift speed of the packerhead is usually late resulting in soft spots in the pipe. A pass repeat cycle is necessary to finish the pipe thereby reducing total pipe production of the day.

Controller 76 is programmed to preset the operational speed of conveyor belt 43 to deliver a substantially steady and even quantity of concrete to mold 18 during the forming of the pipe by packerhead 34. The preset speed of conveyor belt 43 can be adjusted during the production day to compensate for variations of the consistency of the pack force. The packerhead lift speed is the base control for the pack force. The lift speed and direction of movement of packerhead 34 is used to keep the pack force substantially constant. The lift speed and direction of movement of packerhead 34 is used to keep the pack force at a preset pack force. There is a direct relationship between packerhead lift speed and pack force on the pipe being produced. Packerhead 34 will automatically change direction and move down if the pack force is lower than the lower acceptable pack force. The packerhead lift speed is adjusted to use the available concrete that is provided on top of packerhead 34. The pack force on the concrete established by the moving packerhead 34 is not affected as there is always an adequate quantity of concrete on packerhead 34 to produce quality pipe. There is a maximum limit on the lift speed of packerhead 34 so the quality of the pipe is not affected due to rapid lift movement of packerhead 34. In extreme situations the lift speed of packerhead 34 may stop due to a shortage of concrete. The controller 76 for packerhead 34 will reverse valve 63 causing packerhead 34 to drop in mold 18 to where the pack force is below the acceptable level. Controller 76 places the machine cycle on hold and requests a pass repeat. When concrete is available again, the operator resumes the machine cycle.

Packerhead pipe making machine 10 can be operated in manual and automatic cycle modes. The machine operator uses a hand control, such as a wobble stick, in the manual cycle mode to control the down movement of packerhead 34 and first and second pass lift operations of packerhead 34. Controller 76 regulates the lift speed of packerhead 34 during the forming of the pipe in mold 18.

The automatic mode of machine 10 uses a timer to delay the packerhead down signal to allow the machine operator to put the machine on hold or cancel the automatic cycle mode. After this time is elapsed the packerhead down signal is energized to commence the automatic cycle mode. Packerhead 34 moves down through top table cone 42 into mold 18 and through pallet 17. The packerhead positioner 85 signals controller 76 when packerhead 34 is in the down position to commence the barrel feed cycle. Conveyor 43 discharges concrete into mold 18 above the rotating packerhead 34. When the pack force in the barrel section of the pipe reaches a preset pack force packerhead valve 63 is actuated to direct hydraulic fluid to lift cylinders 26 and 27 to lift packerhead 34. A transducer monitors the bell feed pack force and functions to stop the bell feed when the preset bell pack force is reached. After the bell cycle is finished, controller 76 commences the barrel feed cycle. The position of packerhead 34 at the top of the bell section of the pipe can be adjusted automatically with controller 76.

The concrete carried on conveyor 43 is sprayed with water for a period of time determined by a timer prior to discharge of concrete into the barrel section of mold 18. The amount of preset water applied to the concrete is controlled with an adjustable timer. A sensor 86 coupled to controller 73 reads the moisture content in the concrete delivered by conveyor 43 for pipe production. The volume of water is adjustable according to the sensor reading.

A nozzle 87 directs water into the top of mold 18 through feeder table 40. A valve assembly 88 coupled to controller 76 functions to control the flow of water from a water supply 89 to nozzle 87. The water discharged into mold 18 is controlled by the sensor reading of the moisture content of the concrete so that a programmed amount of water can be discharged through nozzle 87 into mold 18 during the forming of the pipe by packerhead 34.

Positioner 85 also activates an automatic jog cycle when packerhead 34 is in the upper or tongue area of the pipe. Packerhead 34 moves up and down or jogs relative to the tongue ring in feeder table 40 to work the concrete in the tongue area to ensure the density of the concrete in the tongue area of the pipe. The number of jog cycles is adjustable.

Feeder table 40 moves up at a slow rate of speed with packerhead 34 up away from the top of mold 18 until the ring of table 40 clears the top of mold 18 to minimize disturbing the tongue of the pipe. As soon as feeder table 40 separates from mold 18 both the packerhead 34 and feeder table 40 are rapidly raised to their up positions.

Feeder table 40 is equipped with a wiper assembly 41 having wipers operable to remove concrete from cone 42 during the bell feed cycle and barrel feed cycle of machine 10. The wipers are selectively moved with a hydraulic fluid driven motor in clockwise and counterclockwise directions. The wipers are driven around cone 42 to move concrete into mold 18 after conveyor 43 commences operation to discharge concrete in the bell section of mold 18 and continues to operate to move concrete into the barrel section of mold 18. The wipers stop when conveyor 43 terminates discharge of concrete to the bell section of the pipe and whenever the pack force is in an overpack situation. The wiper assembly 41 movement resumes under normal pack pressure and stops when packerhead 34 is in the tongue section of the pipe. The direction of movement of the wipers will reverse whenever it becomes stuck. A speed monitoring device coupled to controller 76 functions to determine when the wiper is not moving. The reverse movement of the wipers will help clear concrete from cone 42. The wipers will continue to move in the reverse direction for a period of time determined by a timer and then return to its regular forward movement.

In double pass concrete pipe making machines, the packerhead 34 is sequentially moved two times along the vertical axis of mold 18. The lift speed of packerhead 34 is modulated during the first pass to maintain a constant pack force of the concrete during the forming of the pipe. During the second pass, the packerhead lift speed is maintained constant to eliminate the rings on the inside of the pipe whenever the packerhead stops or is moved at a slow lift speed. The second pass is sued to clean the inside of the pipe.

Packerhead lift speed during the first pass of a single pass operation in the tongue area of the pipe is decreased to minimize disturbance of the pipe tongue. Positioner 85 signals controller 73 when packerhead 34 is in the tongue area. Valve assembly 63 is activated to reduce the flow of hydraulic fluid to cylinders 26 and 27 thereby decreasing the lift speed of the packerhead 34. The packerhead lift speed is also decreased during the second pass of a two-pass operation.

While there has been shown and described an automatic control system for concrete pipe making machines, it is understood that changes in the control apparatus and electrical and hydraulic circuits may be made by those skilled in the art without departing from the invention. The invention is defined in the following claims.

What is claimed is:

1. A method for making concrete pipe with a machine having a packerhead for forming concrete pipe in an upright mold, packerhead motor means for rotating the packerhead, lift means for moving the packerhead in an upward direction in the mold during rotation of the packerhead, conveyor means operable to supply concrete to the mold, said method comprising the steps of:

locating the packerhead in the lower end of the mold;

discharging concrete from the conveyor means into the mold while simultaneously rotating and lifting the packerhead relative to the mold to form a concrete pipe therein;

sensing the power used by the packerhead motor to rotate the packerhead and providing a packerhead motor load signal representative of the power used to rotate the packerhead;

providing a packerhead motor load upper limit reference signal and a packerhead motor load lower limit reference signal;

maintaining the speed of the conveyor means substantially constant when the packerhead motor load signal is between said upper and lower limit reference signals;

varying the lift speed of the packerhead when the packerhead motor load signal is between said upper and lower limit reference signals;

varying the speed of the conveyor means when the packerhead motor load signal is above the upper limit reference signal and below the lower limit reference signal whereby the density of the concrete pipe formed within the mold is substantially uniform throughout its length;

providing an extreme underpack reference signal;

terminating the lift speed of the packerhead and lowering the packerhead into the mold until the packerhead load signal is above the extreme underpack reference signal; and lifting the packerhead when the packerhead load signal is above the extreme underpack reference signal.

2. The method of claim 1 including: decreasing the speed of the conveyor means when the packerhead load signal is above the upper limit reference signal.

3. The method of claim 1 including: increasing the speed of the conveyor means when the packerhead load signal is below the lower limit reference signal.

4. The method of claim 1 including: decreasing the speed of the conveyor means when the packerhead load signal is above the upper limit reference signal and increasing the speed of the conveyor means when the packerhead load signal is above the lower limit reference signal.

5. The method of claim 1 including: adjusting the speed of the conveyor means to maintain a substantially constant supply of concrete into the mold when the packerhead motor load signal is between said upper and lower limit reference signals.

6. The method of claim 1 including: sensing the moisture content of the concrete moved by the conveyor means into the mold, providing a water content signal representative of the sensed moisture content, and adding water responsive to said water content signal to the concrete in the mold to maintain the moisture content of the concrete in the mold at a preset amount.

7. The method of claim 1 including: sensing the vertical positions of the packerhead relative to the mold, providing packerhead position signals of the sensed vertical positions of the packerhead, and changing the lift speed of the packerhead responsive to the packerhead position signals and packerhead motor signals during the forming of the bell, barrel, and tongue sections of the concrete pipe.

8. The method of claim 7 wherein: the lift speed of the packerhead during the forming of the barrel section of the pipe is greater than the lift speeds during the forming of the bell and tongue sections of the pipe.

9. A method for making concrete pipe with a machine having a packerhead for forming concrete pipe in an upright mold, packerhead motor means for rotating the packerhead, lift means for moving the packerhead in an upward direction in the mold during rotation of the packerhead, conveyor means operable to supply concrete to the mold, said method comprising the steps of:

locating the packerhead in the lower end of the mold;

discharging concrete from the conveyor means into the mold while simultaneously rotating and lifting the packerhead relative to the mold a concrete pipe therein;

sensing the vertical position of the packerhead relative to the mold;

providing packerhead vertical position signals of the sensed vertical positions of the packerhead;

changing the lift speeds of the packerhead during the forming of the bell, barrel, and tongue sections of the pipe;

providing a packerhead motor load lower limit reference signal;

providing an extreme underpack reference signal;

lowering the packerhead into the mold until the packerhead load signal is above the extreme underpack reference signal; and lifting the packerhead when the packerhead load signal is above the extreme underpack reference signal.

10. The method of claim 9 wherein: the lift speed of the packerhead during the forming of the barrel section of the pipe is greater than the lift speeds during the forming of the bell and tongue sections of the pipe.

11. The method of claim 9 including: sensing the moisture content of the concrete moved by the conveyor means into the mold, providing a water content signal representative of the sensed moisture content, and adding water responsive to said water content signal to the concrete in the mold to maintain the moisture content of the concrete in the mold at a preset amount.

12. The method of claim 9 including: sensing the power used by the packerhead motor means to rotate the packerhead and providing a packerhead motor load signal representative of the power used, providing a packerhead motor load upper limit reference signal and a packerhead motor load lower limit reference signal, and maintaining the speed of the conveyor means substantially constant when the packerhead motor load signal is between said upper and lower limit reference signals.

13. In a packerhead pipe making machine having a packerhead which is simultaneously rotated by a packerhead motor an lifted by reversible variable speed packerhead lift means to form a concrete pipe within a vertically orientated mold from concrete that is deposited into the mold on top of the packerhead by a conveyor driven by a conveyor motor, a control for the combined regulation of the operating speed of the conveyor and the lift speed of the packerhead to maintain the density of the pipe substantially uniform throughout the length of the pipe, comprising:

means for sensing the power used to rotate the packerhead and for generating a sensed packerhead motor load signal representative of said sensed power, first means for selecting a reference signal defining a motor load representative of a preset pack force, second means for selecting a motor load reference signal of an upper limit reference signal, third means for selecting a motor load reference signal of a lower limit reference signal, means for operating the conveyor at a substantially constant speed when the motor load signal is between the upper and lower limit reference signals, means for varying the lift speed of the packerhead when the motor load signal is between the upper and lower reference signals, means for decreasing the speed of the conveyer when the motor load signal is above the upper limit reference signal to reduce the amount of concrete moving into the mold, means for increasing the speed of the conveyor when the motor load signal is below the lower limit reference signal to increase the amount of concrete moving into the mold, and means providing an extreme underpack reference signal, said packerhead lift means being operable to lower the packerhead in the mold when the motor load signal is below the extreme underpack reference signal and resuming the lifting of the packerhead when the motor load signal is above the extreme underpack reference signal.

14. The combination defined in claim 13 including: means for sensing the moisture content of the concrete moved by the conveyor into the mold and providing a water content signal representative of the sensed moisture content, and means to add water responsive to the water content signal to the concrete in the mold to maintain a selected concrete moisture content.

15. The combination defined in claim 13 including: means for sensing the vertical positions of the packerhead relative to the mold and providing packerhead position signals of the sensed vertical positions of the packerhead, and means responsive to said packerhead position signals for changing the lift speeds of the packerhead during the forming of the bell, barrel, and tongue sections of the concrete pipe.

16. In a packerhead pipe making machine having a packerhead which is simultaneously rotated by a packerhead motor and lifted by reversible variable speed packerhead lift means to form a concrete pipe within a vertically orientated mold from concrete that is deposited into the mold on top of the packerhead by a conveyor, a control for the combined regulation of the operating speed of the conveyor and the lift speed of the packerhead to maintain the density of the pipe substantially uniform throughout the length of the pipe, comprising:

means for sensing the power used to rotate the packerhead and for generating a sensed packerhead motor load signal representative of said sensed power, first means for selecting a reference signal defining a motor load representative of a preset pack force, second means for selecting a motor load reference signal of an upper limit reference signal, third means for selecting a motor reference signal of a lower limit reference signal, means for operating the conveyor when the motor load signal is between the upper and lower limit reference signals to deposit concrete in the mold above the packerhead, means for controlling the lift speed of the packerhead when the motor load signal is between the upper and lower reference signals, and means providing an extreme underpack reference signal, said packerhead lift means operable to lower the packerhead in the mold when the packerhead motor load signal is below the extreme underpack reference signal and resuming the lifting of the packerhead when the motor load signal is above the extreme underpack reference signal.

17. The combination defined in claim 16 including: means for sensing the vertical positions of the packerhead relative to the mold and providing packerhead position signals of the sensed vertical positions of the packerhead, and means responsive to said packerhead position signals for changing the lift speeds of the packerhead during the forming of the bell, barrel, and tongue sections of the concrete pipe.

18. In a packerhead pipe making machine having a packerhead which is simultaneously rotated by a packerhead motor and lifted by reversible variable speed packerhead lift means to form a concrete pipe having a bell, barrel, and tongue sections within a vertically orientated mold from concrete that is deposited into the mold on top of the packerhead by a conveyor, a control for the combined regulation of the operating speed of the conveyor and the lift speed of the packerhead to maintain the density of the pipe substantially uniform throughout the length of the pipe, comprising:

means for sensing the power used to rotate the packerhead during lifting of the packerhead relative to the mold and for generating a sensed packerhead motor load signal representative of said sensed power, first means for selecting a reference signal defining a motor load representative of a preset pack force, second means for selecting a motor load reference signal of an upper limit reference signal, third means for selecting a motor load reference signal of a lower limit reference signal, means for operating the conveyor at a substantially constant speed when the motor load signal is between the upper and lower limit reference signals, means for varying the lift speed of the packerhead when the motor load signal is between the upper reference signal and selected reference signal and between the lower reference signal and selected reference signal with the speed of the conveyor substantially constant to ensure substantially uniform density of concrete throughout the length of the pipe, means for sensing the vertical positions of the packerhead relative to the mold and providing packerhead position signals of the sensed vertical positions of the packerhead, and means responsive to said packerhead position signals for changing the lift speeds of the packerhead during the forming of the bell, barrel, and tongue sections of the concrete pipe.

19. The combination defined in claim 18 wherein: the lift speed of the packerhead during forming of the barrel section of the pipe is greater that the lift speeds of the packerhead during the forming of the bell and tongue sections of the pipe.

20. A method for making concrete pipe with a machine having a packerhead for forming concrete pipe in an upright mold, packerhead motor means for rotating the packerhead, lift means for moving the packerhead in an upward direction in the mold during rotation of the packerhead, conveyor means operable to supply concrete to the mold, said method comprising the steps of:

locating the packerhead in the lower end of the mold;

discharging concrete from the conveyor means into the mold while simultaneously rotating and lifting the packerhead relative to the mold to form a concrete pipe therein;

sensing the power used by the packerhead motor means to rotate the packerhead and providing a packerhead motor load signal representative of the power used to rotate the packerhead;

providing a packerhead motor load upper limit reference signal and a packerhead motor load lower limit reference signal;

controlling the lift speed of the packerhead when the packerhead motor load signal is between said upper and lower limit reference signals;

providing an extreme underpack reference signal;

terminating the lift speed of the packerhead and lowering the packerhead into the mold until the packerhead load signal is above the extreme underpack reference signal; and lifting the packerhead when the packerhead load signal is above the extreme underpack reference signal.

21. The method of claim 20 including: decreasing the speed of the conveyor means when the packerhead load signal is above the upper limit reference signal and increasing the speed of the conveyor means when the packerhead load signal is above the lower limit reference signal.

22. The method of claim 20 including: sensing the vertical positions of the packerhead relative to the mold, providing packerhead position signals of the sensed vertical positions of the packerhead, and changing the lift speed of the packerhead responsive to the packerhead position signals and packerhead motor signals during the forming of the bell, barrel, and tongue sections of the concrete pipe.

23. The method of claim 22 wherein: the lift speed of the packerhead during the forming of the barrel section of the pipe is greater than the lift speeds of the packerhead during the forming of the bell and tongue sections of the pipe.

24. A method for making concrete pipe with a machine having a packerhead for forming concrete pipe in an upright mold, packerhead motor means for rotating the packerhead, lift means for moving the packerhead in an upward direction in the mold during rotation of the packerhead, conveyor means operable to supply concrete to the mold, said method comprising the steps of:

locating the packerhead in the lower end of the mold;

discharging concrete from the conveyor means into the mold while simultaneously rotating and lifting the packerhead relative to the mold to form a concrete pipe therein;

sensing the power used by the packerhead motor means to rotate the packerhead during the lifting of the packerhead relative to the mold and providing a packerhead motor load signal representative of the power used to rotate the packerhead;

providing a packerhead motor load upper limit reference signal and a packerhead motor load lower limit reference signal;

maintaining the speed of the conveyor means substantially constant when the packerhead motor load signal is between the upper and lower limit reference signals;

varying the lift speed of the packerhead when the packerhead motor load signal is between said upper and lower limit reference signals with the speed of the conveyor means substantially constant to ensure substantially uniform density of concrete throughout the length of the pipe;

providing an extreme underpack reference signal;

terminating the lift speed of the packerhead and lowering the packerhead into the mold until the packerhead load signal is above the extreme underpack reference signal; and lifting the packerhead when the packerhead load signal is above the extreme underpack reference signal.

25. The method of claim 24 including: decreasing the speed of the conveyor means when the packerhead load signal is above the upper limit reference signal and increasing the speed of the conveyor means when the packerhead load signal is above the lower limit reference signal.

26. A method for making concrete pipe having bell, barrel and tongue sections with a machine having a packerhead for forming concrete pipe in an upright mold, packerhead motor means for rotating the packerhead, lift means for moving the packerhead in an upward direction in the mold during rotation of the packerhead, and conveyor means operable to supply concrete to the mold, said method comprising the steps of:

locating the packerhead in the lower end of the mold;

discharging concrete from the conveyor means into the mold while simultaneously rotating and lifting the packerhead relative to the mold to form a concrete pipe therein;

sensing the power used by the packerhead motor means to rotate the packerhead during the lifting of the packerhead relative to the mold and providing a packerhead motor load signal representative of the power used;

providing a packerhead motor load upper limit reference signal and a packerhead motor load lower limit reference signal;

maintaining the speed of the conveyor means substantially constant when the packerhead motor load signal is between said upper and lower limit reference signals;

varying the lift speed of the packerhead with the speed of the conveyor means substantially constant to ensure substantially uniform density of concrete throughout the length of the pipe;

sensing the vertical position of the packerhead relative to the mold;

providing packerhead vertical position signals of the sensed vertical positions of the packerhead; and changing the lift speeds of the packerhead during the forming of the bell, barrel, and tongue sections of the pipe.

27. The method of claim 26 wherein: the lift speed of the packerhead during the forming of the barrel section of the pipe is greater than the lift speeds during the forming of the bell and tongue sections of the pipe.

* * * * *